US006182760B1

(12) United States Patent
Phelps

(10) Patent No.: US 6,182,760 B1
(45) Date of Patent: Feb. 6, 2001

(54) SUPPLEMENTARY BOREHOLE DRILLING

(75) Inventor: Leo I. Phelps, Austin, TX (US)

(73) Assignee: Union Oil Company of California, El Segundo, CA (US)

( * ) Notice: Under 35 U.S.C. 154(b), the term of this patent shall be extended for 0 days.

(21) Appl. No.: 09/119,113

(22) Filed: Jul. 20, 1998

(51) Int. Cl.[7] ..... E21B 43/14
(52) U.S. Cl. ..... 166/313; 166/117.5; 166/50
(58) Field of Search ..... 166/117.6, 117.5, 166/50, 52, 313–380

(56) References Cited

U.S. PATENT DOCUMENTS

| | | | |
|---|---|---|---|
| 1,900,163 | 3/1933 | Dana et al. | 255/1.6 |
| 1,900,164 | 3/1933 | Dana et al. | 255/1.6 |
| 2,492,079 | 12/1949 | Wiley | 255/1.6 |
| 2,794,505 | 6/1957 | Allen | 166/86 |
| 3,011,552 | 12/1961 | Rhodes et al. | 166/67 |
| 3,052,301 | 9/1962 | Watts et al. | 166/97 |
| 3,080,922 | 3/1963 | Mater | 166/114 |
| 3,083,768 | 4/1963 | Althouse, Jr. et al. | 166/114 |
| 3,100,529 | 8/1963 | McStravick et al. | 166/52 |
| 3,118,502 | 1/1964 | Cochran | 166/129 |
| 3,170,518 | 2/1965 | Brown | 166/48 |
| 3,223,168 | 12/1965 | Stone | 166/89 |
| 3,269,755 | 8/1966 | Yancey | 285/137 |
| 3,330,355 | 7/1967 | Yancey | 166/46 |
| 3,330,360 | 7/1967 | Young | 166/179 |
| 3,653,435 | 4/1972 | Reistle, III et al. | 166/5 |
| 3,670,507 | 6/1972 | Mott et al | 61/46.5 |
| 4,068,729 | 1/1978 | Peevey | 175/8 |
| 4,291,724 | 9/1981 | Miller | 137/555 |
| 4,396,075 | 8/1983 | Wood et al. | 175/79 |
| 4,415,205 | 11/1983 | Rehm et al. | 299/5 |
| 4,444,276 | 4/1984 | Peterson, Jr. | 175/61 |
| 4,573,541 | 3/1986 | Josse et al. | 175/78 |
| 4,749,046 | 6/1988 | Gano | 166/366 |
| 4,822,212 | 4/1989 | Hall et al. | 405/227 |
| 5,145,004 | 9/1992 | Cornette | 166/278 |
| 5,330,007 | 7/1994 | Collins et al. | 166/313 |
| 5,458,199 | 10/1995 | Collins et al. | 166/97.5 |
| 5,462,120 * | 10/1995 | Gondouin | 166/380 |
| 5,535,822 | 7/1996 | Schock et al. | 166/50 |
| 5,544,704 | 8/1996 | Laurel et al. | 166/117.6 |
| 5,551,509 | 9/1996 | Braddick | 166/57.7 |
| 5,560,435 | 10/1996 | Sharp | 175/5 |

FOREIGN PATENT DOCUMENTS

| | | |
|---|---|---|
| 0136936 | 4/1985 | (EP) . |
| 2220015 | 12/1989 | (GB) . |
| WO9705360 | 2/1997 | (WO) . |

OTHER PUBLICATIONS

Mark E. Teel, "What's Happening in Drilling," World Oil/ Nov. 1993, pp. 525–536.

* cited by examiner

*Primary Examiner*—William Neuder
*Assistant Examiner*—Zakiya Walker
(74) *Attorney, Agent, or Firm*—William O. Jacobson; Gregory F. Wirzbicki

(57) ABSTRACT

A duct assembly for drilling supplementary boreholes comprises a plurality of duct body sections, whipstocks, and separators forming multiple channel segments within the duct body sections. In one embodiment, the separators are plates that substantially divide each duct body section into two semicircular channel setments and align adjoining duct body sections, allowing the drilling of supplementary boreholes to be reliably directed without whipstock repositioning.

23 Claims, 3 Drawing Sheets

SUPPLEMENTARY BOREHOLE DRILLING

FIELD OF THE INVENTION

The invention relates to a device and process for drilling at least two supplementary boreholes from an existing well or borehole. More specifically, the invention is concerned with providing a supplementary borehole drilling device and method for recovering additional oil or natural gas from an existing or abandoned production well.

BACKGROUND OF THE INVENTION

As the discovery of new oil fields or other natural resources becomes more difficult, increased emphasis has been placed on maximizing the recovery of natural resources from known sources. For known oil and gas fields, this emphasis has increasingly required additional wellbores to be drilled into less permeable or less productive portions of the field or a producing subterranean formation, e.g., drilling several supplementary or "step out" boreholes at a deviated angle from a nearly-vertical main portion of a conventional production well. Typically, the position and direction of the supplementary boreholes must be carefully controlled since oil or gas recovery from less productive portions of the field may be less tolerant of direction and positional errors when compared to vertical wells drilled into the more productive portions of the field.

Although supplementary boreholes can be drilled using various methods and devices, many supplementary boreholes have been drilled using a conventional whipstock tool and related apparatus. The conventional whipstock tool is typically prepositioned in a main portion of a well prior to drilling a supplementary borehole. A drill string is then run down the well and is diverted radially outward by the whipstock tool to drill a supplementary borehole into a formation of interest. After drilling the supplementary borehole and withdrawing the drill string, the conventional whipstock tool may be repositioned in the well to allow the drilling of a second supplementary borehole from the well. If several supplementary boreholes are drilled into a thin production zone, repositioning may only essentially require rotation of the whipstock tool within the well. One conventional whipstock with an associated tool assembly is an SS-WS packer and whipstock supplied by TIW located in Houston, Tex., USA. Another conventional means for drilling supplementary boreholes from an existing well is a Baker Downhole Drilling System supplied by the Baker Hughes Company, located in Houston, Tex., USA.

The drilling of supplementary boreholes from existing wells located on offshore platforms can be especially desirable. The limited space on a platform may not allow room for another conventional well to be drilled from the same platform and, even if room exists on the platform, another well may interfere with other closely spaced wells at shallow subsurface locations. One or more supplementary boreholes drilled from an existing well may be used to fracture less permeable formation portions near an existing platform well and/or provide an extended conduit within a shallow thin zone, significantly improving the recovery of oil or other resources.

However, the cost of conventionally drilling these supplementary boreholes has limited their use. The limited incremental amount and value of the recoverable natural resource in a less productive formation or a thin production zone can severely limit the acceptable cost of drilling and completing these supplementary boreholes. Additional risks of damaging the existing well can also result from conventional procedures such as repositioning the whipstock within the existing well and running drilling strings through existing well tubulars.

SUMMARY OF THE INVENTION

The present invention provides a method for drilling multiple supplementary boreholes from an existing borehole or well with an inventive whipstock string, the use of which substantially reduces the cost and time of drilling multiple boreholes by avoiding the need to withdraw the drill sting and reposition the whipstock string. In one embodiment, an inventive whipstock string comprises (1) joined conductor or duct sections having spaced-apart separators that form two semicircular, but discontinuous channels in the whipstock string and (2) a whipstock or end duct section that includes dual whipstocks, a load-bearing separator plate between the whipstocks, and two whipstock drilling ports in the end duct section. In a self-aligning embodiment of the invention, protruding separator plate portions and mating alignment slots are used to reliably self-align and position the duct sections during assembly and running of the whipstock string, allowing drilling of the supplementary boreholes to be more reliably directed into the formation of interest.

The process of using the inventive whipstock string reduces the risk of damaging the existing well and comprises running the whipstock string into the existing well, positioning one of the whipstock drilling ports and a whipstock adjacent to a desired kickoff location for a supplementary borehole, running a drilling assembly through one channel within the positioned whipstock string, and drilling outwardly into the formation to form a supplementary borehole portion. After drilling a first supplementary borehole, a second borehole can be drilled using a drilling assembly in a second channel within the positioned whipstock string. The supplementary boreholes allow fluids to be recovered or injected into a previously unused formation or a formation portion previously producing limited amounts of fluids.

BRIEF DESCRIPTION OF THE DRAWINGS

In these figures, it is to be understood that like reference numerals refer to like elements or features.

DETAILED DESCRIPTION OF THE INVENTION

Figure 1A:
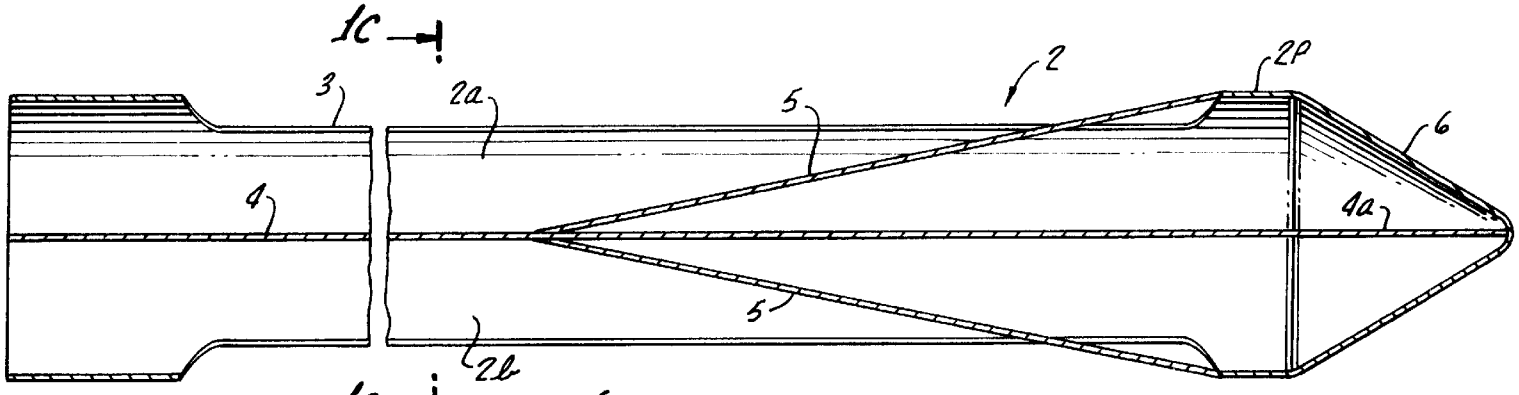
FIG. 1*a* shows a side cross-sectional view of a whipstock section and view plane 1*c*—1*c* of the a cross-sectional end view shown in FIG. 1*c;*
Figure 1B:
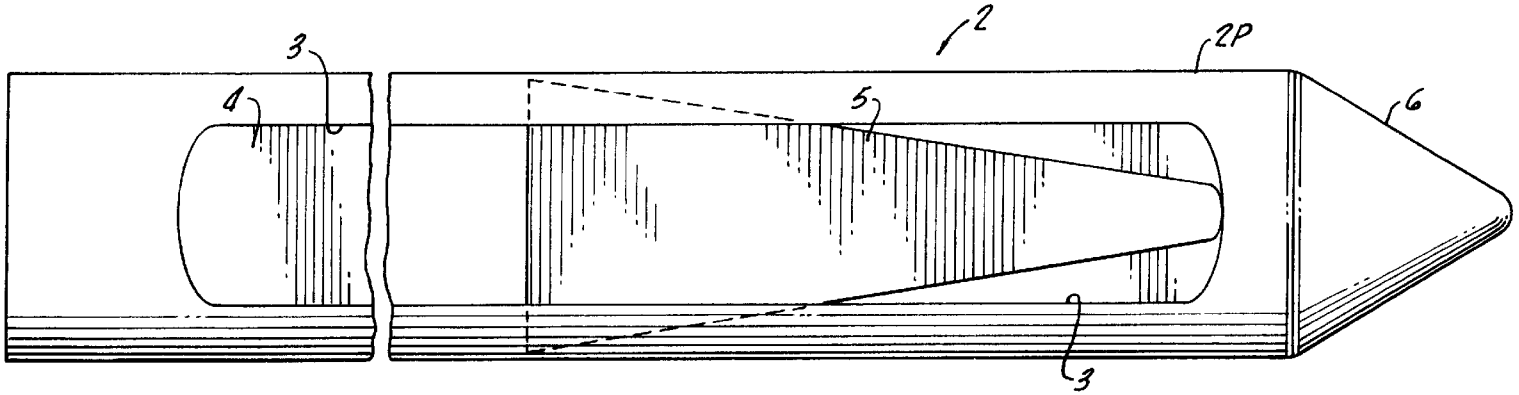
FIG. 1*b* shows a bottom view of the whipstock section shown in FIG. 1*a;*
Figure 1C:
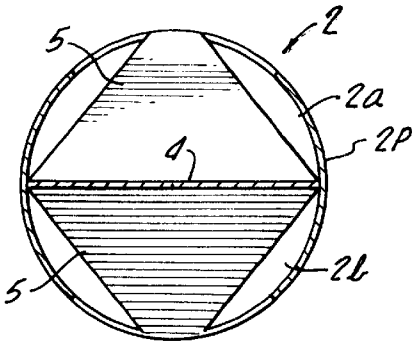
FIG. 1*c* shows a left-to-right cross-sectional end view of the whipstock section shown in FIG. 1*a;*

FIGS. 1*a*, 1*b*, and 1*c* are three views of an end duct or whipstock section 2 of a self-aligning embodiment of the invention. FIG. 1*c* is a cross-sectioned view as viewed at the "1*c*—1*c*" plane shown in FIG. 1*a*.

The whipstock or end duct section 2 shown in FIGS. 1*a*, 1*b*, and 1*c* comprises a modified pipe or tubular section 2*p* having a nominal diameter of about 26 inches and a nominal length of about 40 feet. The modifications include two oblong drilling ports 3 machined out of the wall of the pipe section 2*p*, a whipstock separator 4 dividing the interior of the whipstock section 2 into approximately equal end channels 2*a* and 2*b*, a nose section 6, and two whipstocks 5 or other means for outwardly diverting a running drill bit and string through the oblong drilling ports 3.

Although whipstocks 5 are shown in this embodiment as planar plates, other means are known to those skilled in the art for diverting a running drilling string or assembly from a direction parallel to a borehole centerline to a direction having a radially outward component. These other means for diverting include splitters, planar wedges, arced wedges, cupped plates, pulley sheaves and guides, and other fixed structures and mechanisms for bending or diverting tubulars.

The preferred whipstock pipe 2*p* and whipstock separator 4 provide structural support for the whipstocks 5. The whipstock pipe 2*p* comprises a modified K-55 or N-80 piping section, but other piping, casing or duct-shaped elements may also be used. In an alternative embodiment, other structural support for the whipstocks 5 may be used in combination with or in place of the whipstock pipe 2*p*, including struts between whipstocks or reinforcement struts attached along the length of the whipstocks. Application-specific factors may determine the actual size and type of whipstock support that may be used, e.g., thicker pipe walls for applications where the lateral loads due to waves, currents and pipe reaction forces are predicted to be larger.

The preferred oblong ports 3 in the whipstock pipe 2*p* shown in FIGS. 1*a* and 1*b* extend on opposite sides of the cylindrical walls of the whipstock pipe. The oblong ports 3 are approximately 16 inches wide (as measured in a straight-line between longer edges) and about 30 feet long from one axial end to another. Alternative ports may be as narrow as 5 inches or less (e.g., if a nominal 4-inch diameter drill pipe is to be used to drill slim supplemental boreholes) or nearly as wide as the diameter of the whipstock pipe 2*p*. Other alternative ports may accommodate more than one drill pipe and may be non-oblong or positioned at other angles and axial displacements with respect to each other. In another alternative embodiment, ports (similar to oblong ports 3) are drilled as part of the downhole drilling process. In still another embodiment, instead of ports 3, the whipstocks 5 are placed at a circumferentially open space between a separator-attached nose section 6 and a separator-attached pipe section similar to a shortened whipstock pipe 2*p*.

A substantially conical nose section 6 is attached to one end of the whipstock pipe 2*p* to assist in the translation of the whipstock section 2 within the well during running operations. The means for attaching the nose section 6 to the separator 4 and/or the whipstock pipe 2*p* can include screw threads, welding, bolting, adhesives or other attaching means known to those skilled in the art. The conical sides, angles, and shape of the nose section 6 are typically not critical to the translation-assist and other functions of the nose section 6, e.g., alternative embodiments of the nose section can include hemispherical and ellipsoid shapes.

A whipstock separator or end plate 4 divides the interior of the whipstock section 2 into non-circular channels 2*a* and 2*b*, each substantially semi-circular in cross-section and occupying approximately half of the interior space within the whipstock section along most of the axial length of the section. The portion of end plate 4 in whipstock pipe 2*p* is preferably approximately two inches thick, 26 inches wide and 40 feet long. Because the preferred end plate 4 must withstand a portion of the drill string diverting forces when the supplementary wellbores are drilled, the end plate thickness is typically greater than the thickness of the preferred connecting separator plates 8 (see FIG. 2) or the wall thickness of the preferred whipstock pipe 2*p*. Alternatively, the end plate thickness can be as little as ¼ inch or less if other whipstock structural supports are used or a more flexible drill string is used.

The end plate 4 as shown also includes a substantially triangular portion 4*a* extending into and dividing the interior space of the nose section 6. The triangular portion 4*a* of the end plate 4 is optional, e.g., if needed for structural integrity. Similar to the attachment of the end plate to the whipstock pipe 2*p*, welding is only one of many means for attaching the triangular portion 4*a* to the nose section 6, if required. Thickness of the triangular portion 4*a* is also dependent upon structural consideration, i.e., the thickness of the triangular portion 4*a* may not be the same as the remainder of end plate 4.

Figure 2:
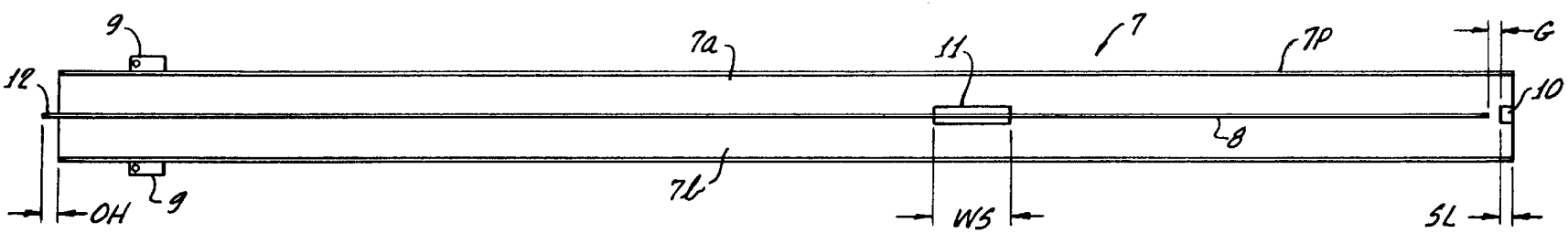
FIG. 2 shows a side cross-sectional view of an embodiment of a connecting duct section.

FIG. 2 shows a side cross-sectional view of one of a string of connecting duct sections 7 of a self-aligning embodiment of the invention. One connecting duct section 7 is also attached at one axial end to the end of the whipstock section 2 opposite from the nose portion 6. The connecting duct section 7 shown in FIG. 2 includes connecting pipe 7*p* similar to the whipstock pipe 2*p*, lifting tabs 9 attached to the connecting pipe, alignment slots 10, one or more optional welding slots 11, and a connecting separator or separator plate 8 which acts as a channel-like guide extending along most, but not all of the axial length of the connecting duct section. The connecting separator plate 8 is similar to the end plate 4 as shown in FIG. 1*a* in that both plates divide the interior of the respective duct sections into approximately equal non-circular cross-section channels, respectively forming string channels 7*a* and 7*b* and end channels 2*a* and 2*b*.

The preferred string separator plate 8 is approximately ⅜ inch thick, 26 inches wide, and under 40 feet long. Attachment of the string separator plate 8 to the connecting pipe section 7*p* is typically by spot welding since a fully welded attachment is typically not required for structural integrity. Spot welding may be accomplished near the ends of connecting separator plate 8 and/or at one or more optional welding slots 11. Alternative methods for attaching the string separator plate 8 to the connecting pipe 7*p* include the use of adhesives, slotting the interior portion of the connecting pipe to mate with the string separator plate 8, and press fitting the string separator plate 8 into the connecting pipe 7*p*.

Figure 3:
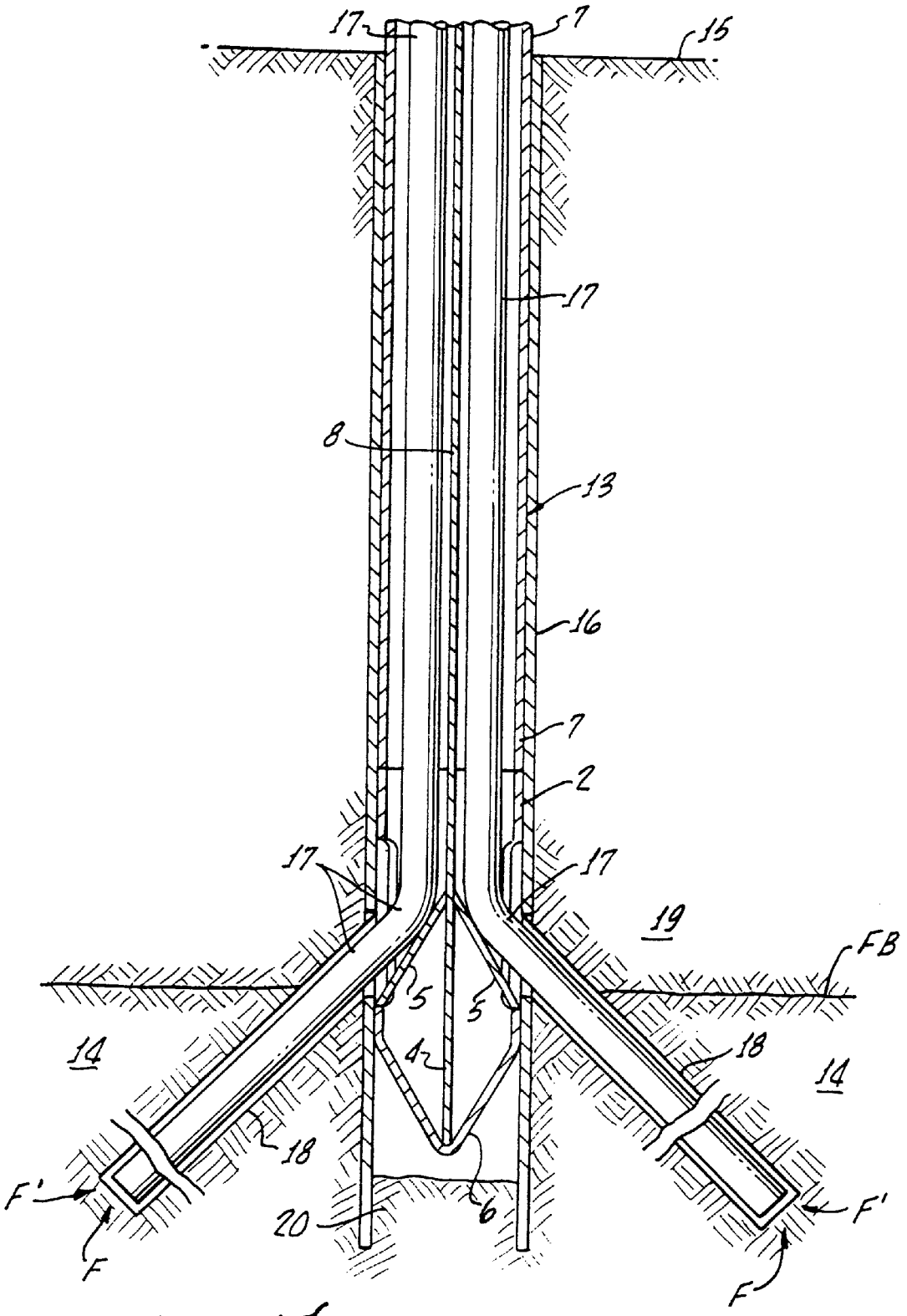
FIG. 3 shows a cross-sectional view of a duct assembly within an underground borehole.

After attaching the string separator plate 8 to the connecting pipe 7*p*, an overhang or protruding portion 12 of the connecting separator plate protrudes a distance or dimension "OH" from one end of the connecting duct section 7. When connecting duct sections 7 are assembled to each other to form a portion of the whipstock string or duct assembly 13 as shown in FIG. 3, the protruding portion 12 of the string separator plate 8 from one connecting duct section 7 shown in FIG. 2 mates with one or more alignment slots 10 machined into an adjoining duct section. The mating of an adjoining protruding portion 12 of separator plate 8 to the adjoining alignment slot(s) 10 assures proper alignment of the channels 7*a* and 7*b* when the duct assembly 13 is placed in a wellbore or cemented casing 16 (see FIG. 3), i.e., the assembly process is self-aligning.

The self-aligning embodiment of the connecting duct section 7 shown in FIG. 2 minimizes field time and labor costs required to run the whipstock string 13 into a cemented casing 16 of the well shown in FIG. 3. This self-aligning feature also allows the drill string to be accurately and reliably directed into the formation when compared to conventional whipstock assemblies using threaded or other non-self-aligning connectors and assemblies.

In applications where rig time and labor costs are relatively inexpensive, another embodiment of the inventive whipstock string uses visually aligned connections between duct sections. The alternative connecting duct sections are similar to connecting duct sections 7 (including an alternative separator or other means for separating the interior of connecting duct sections into channels), but do not include self-aligning means for mating such as the alignment slot(s) 10. However, the alternative separators (e.g., visible when mating and joining duct sections or with protruding portions) or other means for visually aligning the channels (e.g., marks on the pipe indicating the location of the alternative separators) can serve as a visual reference for field labor to align and weld the adjoining alternative duct sections with alternative separators forming reliably aligned channel segments within the alternative duct sections.

Other embodiments of the invention may use still other means for creating channel segments or channel-like passageways within duct sections and other means for aligning the channel segments instead of plate-like separators. These can include guide tubular segments within the whipstock or duct string 13 instead of separators, pipe unions having separators protruding into alternative duct sections that have no separator plates, pipe section keyways mating with string separator plates, pipe connector alignment tabs, and laser alignment devices. These other embodiments may include a combination of channel creating and alignment devices to create a plurality of aligned channels within each duct section.

When the self-aligning connecting duct sections (shown in FIG. 2) are mated, the protruding portion 12 of string separator plate 8 extends into only a portion of the slot length "SL" of adjoining alignment slot 10, i.e., the adjoining separator plates are separated from each other or spaced apart. Overhang dimension "OH" and slot length "SL" are typically less than about two inches, but may be larger. The alignment slot 10 is typically sized to provide matable clearance for the protruding portion 12, i.e., the overhang distance "OH" of the protruding portion 12 of the string separator plate 8 is less than or equal to slot length "SL" of connecting duct section 7. Gap "G" is the minimum spaced-apart distance between a recessed end of the string separator plate 8 proximate to the alignment slot 10 and the bottom of the alignment slot 10, i.e., the minimum space or gap between adjoining separator plates when adjoining sections are assembled. Although the duct sections 7 form a continuous string when mated, the gap "G" produces spaced-apart channel segments within the duct string 13. Although gap "G" can vary widely, it is typically at least about ¼ inch, more typically about one inch.

Optional weld slot 11 allows the separator plate 8 to be more easily welded along its axial length to the connecting duct pipe 7*p*. The length "WS" of optional weld slot 11 in the embodiment shown is typically a few inches, i.e., enough to allow a spot or tag weld of the string separator plate 8 to the wall of the connecting pipe 7*p*, but the slot length may be significantly larger if a longer weld is required for structural integrity. Especially if the weld slot 11 is near an axial end, the slot may also serve as a visual indication of the separator location and be used for visual alignment of the whipstock string 13.

FIG. 3 is a cross-sectional view of a whipstock string or duct assembly 13 after it is positioned within a previously drilled well penetrating an underground formation 14 below a ground or water surface 15. The previously drilled and completed well includes a cement plug 20 and a cemented liner or casing 16. The whipstock string 13 comprises a whipstock section 2 (including a whipstock separator 4) and a plurality of aligned, connecting duct sections 7 (including string separator plates 8), creating at least two non-cylindrical channels leading from near or above the surface 15 to near the whipstocks or drill string diverters 5 in the whipstock section. If supplementary boreholes are to be drilled near the bottom of an existing well or the cement plug 20 as shown, the whipstock section 2 can be landed at the cement plug or at the bottom of the well.

In an alternative embodiment, the whipstock section is similar to the whipstock section 2 as shown except for the lack of a nose section 6. This alternative whipstock section may be located between connecting duct sections 7, i.e., the alternative or intermediate whipstock section is located within the whipstock string 13 rather than at one end of the whipstock string, but spaced apart from the surface 15. This intermediate location of the alternative whipstock section may also require additional means for supporting the whipstock string, e.g., attaching the whipstock string to the well or cemented casing 16. This alternative embodiment may also require additional means for determining downhole position and direction such as position sensors and transmitters.

After being run into the well, the whipstock string 13 is typically supported within the main borehole or cemented casing 16 near surface 15. Means for supporting the whipstock string 13 may include a drilling rig (during running of the string), pipe hangers attaching the whipstock string to a casing or liner, or other conventional hung pipe supporting means known to those skilled in the art.

Two drill strings 17 are shown in FIG. 3 after being run through channels (formed by plates 4 & 8) within the whipstock string or duct assembly 13 and diverted by whipstocks 5 into formation 19 above the underground formation of interest 14. Running can be accomplished using an FMC multi-string or side-by-side wellhead or a Kvaerner Splitter Wellhead System located near the surface (not shown for clarity). Such a system is available from FMC Corporation located in Houston, Tex., USA, or from Kvaerner National AS located in Norway. After each of the drill strings 17 has been run to a whipstock 5 and been diverted, the supplementary boreholes 18 are drilled (through the cemented casing 16 and formation 19, if required) radially outward and downward past the formation boundary FB and into the underground formation 14. A typical drill string 17 includes a drill bit (e.g., a rotating bit or a fluid jet cutter or other means for cutting into and removing formation material) and joined sections of drill pipe or other tubulars extending to the surface 15. As shown, the supplementary boreholes 18 are substantially straight and deviated at a 45-degree angle from the vertical direction, but other directions, sizes, lengths, and shapes of supplementary boreholes are also possible.

After drilling, one or more drill strings or assemblies 17 may be fluidly connected to fluid storage, transport, pumping or other fluid handling facilities (not shown for clarity) at or near the surface 15, allowing oil, gas, coal slurry, cement slurry, or other fluid-like materials to be recovered or injected. Because the connected drill strings 17 in this embodiment act as separate tubulars extending to the surface from each of the supplementary boreholes 18, separate completion and fluid recovery operations can be accomplished for each supplementary borehole. Potential separate fluid recovery operations are shown in FIG. 3 by fluid flow arrows F and F'. Instead of using the drill strings 17 as completion tubulars for the supplementary boreholes 18, alternative embodiments can use various other types of well completion methods, including open hole, perforated liner, gravel pack, and/or cementing of the drill string or other tubulars within the borehole.

Compared to conventional whipstock devices and methods, using the inventive assembly can provide significant cost advantages, e.g., significant reductions in on-site rig-time and repositioning tool costs. Avoiding the previously required withdrawing and repositioning steps before drilling subsequent supplementary boreholes also reduces the risk of damaging tubulars in the well during these process steps, e.g., tubular fatigue failures, work-hardening or embrittlement of the tubulars, and buckling of the drill string and/or erosion of casing or other tubulars in the well. These avoided risks, drilling steps, and costs can be particularly significant for offshore applications. The orientation accuracy of the whipstock placement downhole resulting from the axially spaced apart and duct-end protruding separators or other alignment means further reduces risk and drilling costs while producing reliably located supplementary boreholes.

An example process of drilling supplementary boreholes in a previously abandoned and plugged offshore well is provided below to show a mode of using an embodiment of the inventive apparatus. The previously abandoned well has a removable conductor extending downward from an offshore platform to a step out area to be drilled at or near the mudline. Drilling a supplementary borehole using a dual mudline whipstock typically requires no more than about a 13.0 pound per gallon (PPG) drilling mud and the step-out area to have previously been cleared if necessary. The embodiment of the inventive apparatus used for this application provides two channels within a conductor string run into the abandoned well, the channels extending from near the offshore platform to a dual mudline whipstock section located near the well mudline. The dual mudline whipstock section of this embodiment is generally similar to the end or whipstock section 2 shown in FIGS. 1 and 3 except that the drilling strings are outwardly diverted at typically less than the 45 degree angles from the string centerline as shown in FIG. 3. The conductor string of this embodiment is generally similar to the whipstock string 13 shown in FIG. 3 except that the string extends from the offshore platform near or above a water line to near or below a mudline within an abandoned well, and the mudline is in a location similar to the formation boundary FB shown in FIG. 3.

Implementing the example process requires a drill rig to be moved or skidded into position on the offshore platform. The drill rig (with conventional tools) is used to cut the existing 26 inch nominal diameter conductor from about 5 feet below the mudline and pull the cut portion of the conductor. This leaves a 26 inch conductor stub within the well extending downward from near the mudline.

Using the drill rig, a Kvaerner Splitter Wellhead System is installed and a nominal 26 inch diameter, dual mudline whipstock section (similar to the whipstock section 2 shown in FIG. 1*a*) is picked up and run down (including assembling & aligning multi-channel conductor sections similar to connecting duct section 7 shown in FIG. 2) and landed on the conductor stub. The self-aligning mating of conductor sections assures that at least one of the whipstocks is maintained at the desired azimuth in the well, but checking the azimuth of the whipstock is desirable, if possible, after landing the conductor and dual mudline whipstock section and making adjustments, if required.

Since each divided or multi-channel conductor section has approximately a 2 inch extension piece of a ⅜ inch thick divider or separator plate (similar to protruding portion 12 of connecting separator plate 8 shown in FIG. 2) extending out from the top end and a mating notch (similar to alignment slots shown in FIG. 2) on the bottom end, mating the extensions and notches self align the separator plates of the divided conductor section during the process of assembly and running into the well. Small guide lips are also pre-welded on the inside of the conductor wall near the top of each conductor section a few inches from the separator plate or divider. The guide lips act to further aid in aligning when stabbing or mating the conductor sections.

Running the divided conductor string typically requires a lifting beam, the removal of master bushings from the drill rig table and the lowering of each 26 inch conductor section through the drill rig table. By positioning the conductor sections on the table with respect to the beams used in pulling the conductor sections, padeyes will land out on the beams.

Once aligned, assembled, and mated, the conductor sections are welded together. Although a self-aligning embodiment is used in this example, conductor sections are also typically welded for structural integrity and to maintain alignment. The conductor sections may also be welded to maintain fluid pressure integrity, if required. Typically for applications which do not require pressure integrity, only about ¾ of the gap between the joints of 26 inch casing pipe or conductor sections is filled using E7016 welding rods and this is sufficient to satisfy structural integrity requirements. If non-self aligning conductor sections are used, alignment is accomplished prior to welding conductor sections to each other.

For the dual mudline whipstock section with pre-cut outwardly facing slots or holes (similar to oblong ports 3 shown in FIG. 1*b*) to be located in or transition a splash zone, the slots or holes should be covered during running the section into the well. Covers can be created by using a cut-off plate or conductor pipe wall portion and tag welding the covers onto the conductor near the slots or holes. The cover plate should be dimet coated or otherwise suitably protected for service in the splash zone. Removal of the covers is typically accomplished prior to running the conductor string.

Many platform guidebuckets that handle nominal 26-inch diameter conductor sections have a nominal inside diameter (ID) of about 27 inches. This requires that any connector weld be nearly flush with the conductor wall and the conductors are welded together without much deviation. The padeyes also need to be removed to allow the conductors to go through the guidebuckets. The guidebucket and other pipe diameter limitations also typically require an integral hanger/packoff to be used.

When the dual mudline whipstock section is at the desired depth near the mudline, a 33 inch OD starter head is welded onto the top of the uppermost conductor section. This weld is a structural weld but need not be a pressure weld.

The starter head is typically visually aligned with the uppermost 26 inch divided conductor section by using a drainage hole located in the middle of the starter head. The orientation of the uppermost separator or channel divider plate can be seen through the drainage hole, allowing the whipstock string to be oriented and aligned.

A nominal 11 inch diameter wear bushing and retainer plate is installed by hand on the starter head. Using a suitable drill string (e.g., 5 inch nominal diameter drill pipe sections and a nominal 8½ inch diameter drill head backreaming as necessary) with a downhole rotary motor installed through the wear bushing, the drill head and string are run substantially within a channel and deviated by a whipstock. An initial portion of the first supplementary borehole (having a nominal diameter of 11¾ to 12¼ inches) is drilled with about 800 gpm of circulating seawater to a distance or depth of about 550 feet to 850 feet beyond the whipstock location by first drilling an 8½ inch nominal diameter borehole, then underreaming the borehole.

Drilling speed will vary with conditions, but the containment of the drill string within one of the channels of the conductor section should reduce the risk of damage to well tubulars and allow a greater drilling speed than if the same size drill string was uncontained within the cased well. After drilling and underreaming, the initial borehole portion is swept with 100 BBLS of mud, preferably a HI-VIS mud. After sweeping, the mud is displaced in the borehole with seawater and the drill string may be pulled out of the borehole portion.

Casing sections having a 9⅝ inch nominal diameter for another portion of the first supplementary borehole are racked up and run through the previously drilled 11¾ to 12¼ inch diameter portion of the first supplementary borehole. An integral hanger/packoff having a 9⅝ inch nominal diameter is landed in the 33 inch nominal OD starter head when the casing has reached the desired depth within the drilled borehole portion. Casing is then cemented in the initial drilled borehole portion using conventional procedures followed by racking down of the cementing equipment and laying out the landing joint. Other portions of the first supplementary borehole portion can now be drilled and completed.

An 11 inch nominal diameter wear bushing and retainer plate are installed on the other side or channel of the divided conductor and the rig positioned over the other slot on the wellhead system. If required, a gyro survey can be run after the rig is positioned to provide additional positional accuracy.

Using a similar or otherwise suitable drill string with a downhole rotary motor installed through the wear bushing, an initial and subsequent portions of a second supplementary borehole portion are drilled and cased similar to the first supplementary borehole. The initial portion of the second supplementary borehole portion is typically directed to a location substantially opposite to the first supplementary borehole portion and deviated from the vertical direction.

Drilling one or more additional portions of either supplementary borehole can be accomplished by picking up a splitter wellhead body, preferably a Kvaerner Splitter Wellhead system, and lowering it onto the starter head. After drilling with circulating seawater, the additional borehole portions are typically swept with 50 BBLS of gel mud and the drilling string is typically pulled out while running. A casing string is typically run into each borehole portion while fluid is being swept or circulated and while the casing string is being rotated. The casing string is supported on hangers or other supporting means and cement supply and return lines are rigged up to cement the casing string within the additional portions of one or both supplementary boreholes.

Although the preferred and alternative apparatus and process embodiments have been described, still other alternative apparatus and process embodiments are possible. These include: placing drilling string sections within the whipstock string or connecting duct sections as both are simultaneously run into a well (rather than running the drilling string after the whipstock string is run into the well); eliminating separator or divider plates in some of the connecting duct sections; creating fluid tight channels within the duct assembly using elastomeric seals to fill gaps "G" (shown in FIG. 2); drilling supplementary boreholes using water jet cutting tools; creating the channels within the connecting duct or whipstock sections using flexible and/or non-metallic separator plates or guides; and adding the step of sealing unused oblong ports or openings in the whipstock section after drilling a supplementary borehole.

While a preferred embodiment of the invention has been shown and described, and various alternative embodiments also shown and/or described, other changes and modifications may be made thereto without departing from the invention. Accordingly, it is intended to embrace within the invention all such changes, modifications and alternative embodiments as fall within the spirit and scope of the appended claims.

What is claimed:

1. A tool apparatus useful for drilling supplementary boreholes emanating from a pre-existing borehole extending to a previously-produced fluid reservoir, said apparatus comprising:

a duct assembly comprising a plurality of joined duct sections, said duct assembly extending towards said fluid reservoir when said duct assembly is located within said well;

a plurality of whipstocks attached to said duct assembly, wherein at least one of said whipstocks is proximate to said fluid reservoir when said duct assembly is located within said well; and a plurality of separators attached to at least two of said duct sections such that separators attached to adjoining duct sections are longitudinally spaced-apart, said separators form at least two channel segments for guiding a drill string within said channel segments towards one of said whipstocks.

2. The apparatus of claim 1 which also comprises means for aligning said separators within said duct sections.

3. The apparatus of claim 2 wherein said means for aligning comprises a protruding portion of said separator in one duct section which mates with a slot in an adjoining duct section.

4. The apparatus of claim 3 wherein said separator is a substantially planar plate.

5. The apparatus of claim 4 wherein said planar plate extends from said protruding portion near one end of said duct section to a recessed location near the opposite end of said duct section.

6. The apparatus of claim 5 wherein a gap remains between adjoining planar plates when said duct sections are joined.

7. The apparatus of claim 6 wherein said gap is at least about 1 inch.

8. The apparatus of claim 2 which also comprises means for supporting said duct assembly substantially within said underground well.

9. The apparatus of claim 8 which also comprises a drill string for drilling said supplementary boreholes, wherein said drill string is capable of being run within one of said channel segments prior to being diverted by one of said whipstocks.

10. The apparatus of claim 2 which also comprises a lifting lug attached to an exterior surface of one of said duct sections.

11. The apparatus of claim 1 wherein said whipstocks comprise two whipstocks opposingly located at substantially the same axial location along the duct assembly.

12. The apparatus of claim 11 wherein said whipstocks are at least partially structurally supported by a duct separator.

13. The apparatus of claim 11 which also comprises a nose cone attached to one end of said duct assembly near said whipstocks.

14. An apparatus for drilling supplementary boreholes from an underground hole, said apparatus comprising:

a duct string composed of duct sections extending from a near-surface location to a subsurface location when said duct string is located within said underground hole;

a plurality of diverters for diverting a drill string radially outward from said underground hole, wherein said diverters are attached to said duct string; and a plurality of dividers attached to said duct sections such that dividers in adjoining duct sections are longitudinally spaced-apart, said dividers forming channel segments within said duct string, wherein at least one of said channel segments is capable of guiding said drill string towards one of said diverters.

15. The appparatus of claim 14 wherein said diverters comprise two diverters oppposingly located at substantially the same axial location.

16. A tool apparatus useful for drilling supplementary boreholes extending from a subsurface location within an underground well to a location within an underground formation, said apparatus comprising:

a duct section, said duct section capable of being placed at said subsurface location within said well;

a plurality of whipstocks attached to said duct section;

a nose cone attached to one axial end of said duct section; and a duct separator attached to said duct section such that said duct separator and duct section form at least two channels for guiding a drilling assembly within said duct section wherein said duct separator is a substantially planar plate forming two substantially semicircular-shaped channels and wherein said duct separator does not extend over the entire length of said duct section.

17. The apparatus of claim 16 wherein said whipstocks are located at substantially the same axial location along said duct section.

18. A process for drilling a plurality of supplementary boreholes extending outward into a subterranean formation from a well, said process comprising:

positioning a tool within said well, said tool comprising a plurality of joined duct sections forming a duct assembly, a plurality of diverters attached to said duct assembly, and a plurality of longitudinally spaced-apart channel guides attached to said adjoining duct sections forming a plurality of passageway segments extending within said duct assembly;

running a drilling assembly through one of said passageway segments and one of said diverters; and drilling outwardly into said formation to form a first supplementary borehole.

19. The process of claim 18 which also comprises the step of completing said supplementary borehole using at least a portion of said drilling assembly.

20. The process of claim 19 which also comprises the step of producing formation fluids through said drilling assembly portion.

21. The process of claim 18 which also comprises the step of drilling a second supplementary borehole without repositioning said tool after drilling said first supplementary borehole.

22. The process of claim 21 which also comprises the step of running a drilling assembly through said other passageway segment and said other diverter.

23. A process for drilling a plurality of supplementary boreholes from an existing well into a subsurface formation which comprises:

placing a whipstock string in said well wherein said whipstock string comprises a nose cone on one axial end of joined duct sections and a plurality of whipstocks wherein a separator is attached substantially within said duct sections such that said separators in adjoining duct sections are longitudinally spaced-apart;

running a drill string though said whipstock string; and drilling a plurality of supplementary boreholes into said formation, each at different locations in said formation without substantially repositioning said whipstock string.

* * * * *